US012023598B2

(12) United States Patent
Valtiner-Zuegg et al.

(10) Patent No.: US 12,023,598 B2
(45) Date of Patent: Jul. 2, 2024

(54) MOTION SIMULATOR FOR AN ENTERTAINMENT SYSTEM, AND ENTERTAINMENT SYSTEM

(71) Applicant: V&P Rides GmbH, Lienz (AT)

(72) Inventors: Saskia Valtiner-Zuegg, Lienz (AT); Martin Valtiner, Lienz (AT)

(73) Assignee: V&P Rides GmbH, Lienz (AT)

( * ) Notice: Subject to any disclaimer, the term of this patent is extended or adjusted under 35 U.S.C. 154(b) by 328 days.

(21) Appl. No.: 17/665,730

(22) Filed: Feb. 7, 2022

(65) Prior Publication Data

US 2022/0249964 A1 Aug. 11, 2022

(30) Foreign Application Priority Data

Feb. 5, 2021 (AT) ..... A 50073/2021

(51) Int. Cl.
*A63G 31/16* (2006.01)
*A63G 31/02* (2006.01)

(52) U.S. Cl.
CPC ..... *A63G 31/16* (2013.01); *A63G 31/02* (2013.01)

(58) Field of Classification Search
CPC ..... A63G 31/00; A63G 31/02; A63G 31/04; A63G 31/16; A47B 29/00
USPC ..... 472/59, 60, 130; 434/55
See application file for complete search history.

(56) References Cited

U.S. PATENT DOCUMENTS

| | | | | |
|---|---|---|---|---|
| 1,789,680 | A | 1/1931 | Gwinnett | |
| 4,066,256 | A | 1/1978 | Trumbull | |
| 4,461,470 | A | 7/1984 | Astroth et al. | |
| 8,920,251 | B2 | 12/2014 | Dietz et al. | |
| 9,289,693 | B1 * | 3/2016 | Morris | A63G 31/16 |
| 9,393,497 | B2 | 7/2016 | Valtiner-Zuegg et al. | |
| 2014/0274431 | A1 | 9/2014 | Schmidt | |
| 2016/0236100 | A1 * | 8/2016 | Douglas | G09B 9/02 |
| 2018/0221778 | A1 | 8/2018 | Blum et al. | |
| 2018/0247557 | A1 * | 8/2018 | Brice | G09B 9/04 |

FOREIGN PATENT DOCUMENTS

| | | | |
|---|---|---|---|
| AT | 513435 | B1 | 2/2015 |
| CN | 101940842 | A | 1/2011 |
| CN | 101991952 | A | 3/2011 |
| CN | 202044766 | U | 11/2011 |
| EP | 2572766 | A1 | 3/2013 |

* cited by examiner

*Primary Examiner* — Kien T Nguyen

(74) *Attorney, Agent, or Firm* — Laurence A. Greenberg; Werner H. Stemer; Ralph E. Locher

(57) ABSTRACT

A motion simulator for an entertainment system has a movable platform with one or more viewing positions and a supporting element for spectators to lean against. The platform is mounted on a support so as to have limited movability. A drive for moving the movable platform relative to the support has a cable drive fastened on the one hand to the support and on the other hand via at least one attachment point to the platform. An energy storage device is fastened between the support and the platform. The drive device pivots the platform about a pivot axis oriented substantially orthogonally to a central axis. The attachment point of the energy storage device and the point(s) of the cable drive device to the platform are arranged between the first pivot axis and the front face. The energy storage device pushes against the bottom face of the platform.

21 Claims, 17 Drawing Sheets

SECTION IX - IX

N = +20° / R = 0°

N = -7° / R = +4°

N = +12° / R = +7°

N = +14° / R = 0°

N = 0° / R = -4°

N = +9° / R = -5°

MOTION SIMULATOR FOR AN ENTERTAINMENT SYSTEM, AND ENTERTAINMENT SYSTEM

CROSS-REFERENCE TO RELATED APPLICATION

This application claims the priority, under 35 U.S.C. § 119, of Austrian Patent Application AT A50073/2021, filed Feb. 5, 2021; the prior application is herewith incorporated by reference in its entirety.

FIELD AND BACKGROUND OF THE INVENTION

The present invention relates to a motion simulator for an entertainment system. The device has a movable platform comprising a top face, a bottom face, a front face, a rear face, and a central axis running from the rear face to the front face. There is arranged on the top face at least one viewing position having a supporting element for spectators to lean against, a support for the platform, wherein the platform is mounted via its bottom face on the support so as to have limited movability, and a drive device for moving the movable platform relative to the support, wherein the drive device comprises a cable drive device for pulling the movable platform, wherein the cable drive device is fastened on the one hand to the support and on the other hand via at least one attachment point to the platform, and an energy storage device which is fastened on the one hand to the support and on the other hand via an energy storage device attachment point to the platform, wherein the platform is pivotable by the drive device about a first pivot axis oriented substantially orthogonally to the central axis. The present invention relates additionally to an entertainment system having such a motion simulator.

Motion simulators are used in order that people on the motion simulator are able to experience a movement which, for example, is shown on a screen. This person thus has an even more realistic film experience, since they do not simply sit or stand quietly but experience the movements almost for real.

An example of such a motion simulator in which a large number of people or spectators simultaneously stand on a platform of such a simulator is known from Austrian Patent No. AT 513435 B1. There, the simulation platform is suspended from cables. The cables are movable by a controlled drive device.

A further example of an amusement ride suspended from cables is known from EP 2 572 766 A1. US 2014/0274431 A1 and CN 101991952 A also disclose devices with cables.

On the other hand, there are also numerous variants in which the simulation platform effectively stands on the drive devices. In this connection, reference may be made to US 2018/0221778 A1, U.S. Pat. Nos. 1,789,680 and 4,066,256. Especially in the case of the two last-mentioned documents, the screen and the platform are readily visible, wherein the spectator viewing positions arranged on the platform are oriented in the direction of the screen. The platforms each have a notional central axis, which runs centrally towards, or is oriented towards, the screen. According to the activation of the drive devices, the platform can be pivoted about a pivot axis oriented substantially orthogonally to the central axis. The front face of the platform thereby moves up and down in the vertical direction. This corresponds to tilting in the form of pitching.

Motion simulators are further known in which there is usually only one person on the platform. Examples thereof are to be found in CN 101940842 A, CN 202044766 U and U.S. Pat. No. 4,461,470. It is a common feature of these three mentioned documents that, on the one hand, tilting of the platform is initiated via at least one cable by pulling. In addition, there is an element which acts against the pulling. In the two first-mentioned specifications, a type of piston damper or a lever arrangement is provided for this purpose; in the third-mentioned specification, a spring is mentioned, which spring pushes the platform downward as soon as the cables no longer pull the platform.

SUMMARY OF THE INVENTION

It is accordingly an object of the invention to provide a motion simulator, which overcomes the above-mentioned disadvantages of the heretofore-known devices and methods of this general type and which provides for an improvement and/or an alternative to the prior art. In particular, the novel simulator is to be of compact construction, is to have a large range of motion, is to be of structurally simple construction, and/or is to function relatively quietly.

With the above and other objects in view there is provided, in accordance with the invention, a motion simulator for an entertainment system, the motion simulator comprising:

- a movable platform having a top face, a bottom face, a front face, a rear face, and a central axis extending from the rear face to the front face, wherein the top face having at least one viewing position with a supporting element for spectators to lean against;
- a support for the platform, the bottom face of the platform being mounted on the support so as to have limited movability; and
- a drive device for moving the movable platform relative to the support, the drive device including:
  - a cable drive device for pulling the platform, the cable drive device being fastened to the support and to at least one attachment point at the platform; and
  - an energy storage device fastened to the support and, via an energy storage device attachment point, to the platform;
- the platform being pivotable by the drive device about a first pivot axis oriented substantially orthogonally to the central axis;
- the energy storage device attachment point and the at least one attachment point attaching the cable drive device to the platform being arranged between the first pivot axis and the front face; and
- the energy storage device being disposed to push against the bottom face of the platform.

Because the energy storage device attachment point and the at least one attachment point of the cable drive device to the platform are arranged between the first pivot axis and the front face, the space on the bottom face of the platform is used economically. It is thus not necessary on the one hand to push and on the other hand to pull in opposite regions (front face and rear face), but simple attachment of the components of the drive device in the region of the front face is sufficient. The connection of the drive device to the platform is thus simpler.

Also, the novel motion simulator is characterized in that the platform is movable in at least two degrees of freedom, and preferably in three degrees of freedom of motion.

Because the energy storage device pushes against the bottom face of the platform, the pulling initiated by the cable drive device can be counteracted in a simple manner. The movement of the platform can thus be controlled optimally and simply. In other words, the force of the (at least partially tensioned or loaded) energy storage device acts from the support in the direction of the bottom face of the platform. The platform is thus pushed upward in the front region by the energy storage device.

It is possible per se that the attachment point of the cable drive device to the platform is identical with the energy storage device attachment point. In the case of such a configuration, the platform can, however, be moved via this one point, so that the platform is pivotable only about the first pivot axis.

It is therefore preferably provided that the attachment point of the cable drive device to the platform is spaced apart from the energy storage device attachment point. A further degree of freedom for the movement of the platform is thereby achieved.

The platform can have any desired shape, as long as there is room thereon for at least one spectator.

For simple production, it is preferably provided that the platform has a substantially planar base plate with a substantially smooth top face and a substantially smooth bottom face. However, various protrusions or indentations can of course be formed in or on the base plate, for example in order to increase the stability.

The base plate of the platform, in a plan view, can be substantially circular or oval. Preferably, the base plate, in a plan view, is quadrangular.

Particularly preferably, the base plate, in a plan view, is in the form of an isosceles trapezium. In such a trapezium, the longer of the two parallel sides forms the front face and the shorter forms the rear face. The central axis divides this trapezium into two mirror-symmetrical regions of equal size.

The support should at least be so configured that the platform is able to pivot on the support about the first pivot axis.

It can also be provided that the support has a ball joint (which also forms the first pivot axis), wherein the platform is mounted via this ball joint on the support so as to have limited movability.

For a simple construction, it is preferably provided that the support has a base, preferably a fixed base, a first pivot bearing, and a pivot element which is connected to the platform and is mounted on the first pivot bearing so as to be pivotable about the first pivot axis.

This pivot element can be in the form of, for example, a profiled support element. The platform can be fastened directly or indirectly to this pivot element.

In order to achieve uniform and central energy transmission from the energy storage device to the platform, it is preferably provided that the energy storage device attachment point to the platform lies in a vertical plane enclosing the central axis.

According to a preferred exemplary embodiment it is provided that the platform, by relaxation (or unloading) of the energy storage device, is able to be tilted about the first pivot axis.

As a result of this relaxation (or unloading), the forward face, or front face, of the platform is moved upward. A movement of the front face of the platform downward is effected in that the platform is able to be tilted about the first pivot axis by actuation of the cable drive device, preferably by simultaneous actuation of the two cable drive units.

According to the actuation of the cable drive device (and the reactional force of the energy storage device), a pitch angle of the platform is obtained, wherein a maximum pitch angle range of about 30° is provided.

The pitch angle—as well as the roll angle and yaw angle mentioned hereinbelow—are orientation angles which are actually used to describe the orientation of a vehicle in three-dimensional space. In this case, the platform forms the vehicle so to speak. The central axis corresponds to the viewing direction when theoretically travelling straight ahead. The pitch angle is thus the angle by which the front face of the platform tilts (or "pitches"). The first pivot axis forms the Y-axis in a corresponding coordinate system.

The pitch angle range—starting from a horizontal plane—can extend both above and below this horizontal plane. For example, the pitch angle range can extend in equal portions above and below the horizontal plane (e.g. tilt upward 15° and tilt downward 15°). However, any desired other division may also be made.

The same applies to the roll angle range described hereinbelow.

For the yaw angle range described hereinbelow, the same applies in respect of a vertical plane enclosing the central axis.

It is further preferably provided that the support has a second pivot bearing, preferably formed in (or on) the pivot element, for the platform, wherein the second pivot bearing has a second pivot axis which is preferably oriented orthogonally to the first pivot axis.

It is particularly preferably provided that the second pivot axis is oriented parallel to the central axis.

In addition, it is preferably provided that the second pivot axis is arranged in a vertical plane enclosing the central axis.

According to a preferred exemplary embodiment it is provided that the platform, by pulling the cable drive device, is able to be tilted about the second pivot axis, preferably in a roll angle range of not more than 25°.

The roll angle is thus the angle by which the lateral regions of the platform tilt (or "roll"). The second pivot axis forms the X-axis in a corresponding coordinate system.

In principle, it is possible that the cable drive device has only one cable, which is connected to the platform.

However, in order to achieve more movement possibilities, it is preferably provided that the cable drive device has a first cable drive unit and a second cable drive unit separate from the first cable drive unit, wherein the first cable drive unit is fastened on the one hand to the support and on the other hand via a first attachment point to the platform, and the second cable drive unit is fastened on the one hand to the support and on the other hand via a second attachment point to the platform.

Where there are two attachment points, it is also provided that the first attachment point and the second attachment point to the platform are arranged between the first pivot axis and the front face.

In order to permit a rapid and simple tilting movement by the roll angle, it is preferably provided that these two attachment points are formed laterally—that is to say spaced apart from the central axis—on the platform.

Accordingly, it is preferably provided that the first attachment point of the first cable drive unit to the platform is arranged between the second pivot axis and a first lateral region of the platform.

In addition, it is preferably provided that the second attachment point of the second cable drive unit to the platform is arranged between the second pivot axis and a second lateral region of the platform, wherein the second lateral region is opposite (or remote from) the first lateral region.

It is further preferably provided that the first attachment point and the second attachment point to the platform are arranged on mutually opposite sides of the central axis.

In order to introduce movement uniformly into the platform, it is particularly preferably provided that the first attachment point and the second attachment point are at the same distance from the central axis.

According to a preferred exemplary embodiment it is provided that the cable drive units each have a cable fastened to the platform, a cable drive, preferably in the form of a cable reel, for pulling the cable, preferably for winding and unwinding the cable, which cable drive is movably, preferably rotatably, mounted on the support, and a drive assembly, preferably an electromotive drive assembly, for driving the cable drive, preferably for rotating the cable reel.

Alternatively, it can be provided that the cable drive is in the form of a piston-cylinder unit or in the form of a linear drive, wherein the cable is then correspondingly fastened thereto at one end.

It is further preferably provided that the cables are each able to be deflected about a deflecting roller which is rotatably mounted on the support, preferably on the base thereof.

With regard to the energy storage device, it is preferably provided that the energy storage device, which is preferably in the form of a spring. In a preferred embodiment, the device is a gas spring, or hydro-pneumatic spring element. The spring may have a cylinder which is attached to the platform, preferably via a rotary joint (which forms the energy storage device attachment point), and a piston which is attached to the support, preferably via a rotary joint.

The attachment can also be reversed, so that the piston is fastened to the platform while the cylinder is fastened to the support.

In order to be able to limit the movements, or the speeds of movement, there is preferably provided at least one braking device for braking the movement of the cable drive device and/or of the energy storage device, wherein the braking device is fastened on the one hand to the support and on the other hand to the platform.

It is particularly preferably provided that the braking device has a piston rod and a cylinder, wherein the piston rod is able to be braked in the cylinder by frictional engagement or by positive engagement by a clamping element.

Preferably, a maximum speed (or maximum acceleration) of the platform of 2 m/sec is possible with the drive device.

In order to achieve a further degree of freedom, there is preferably provided a rotary device for rotating the platform about a vertical axis of rotation.

It can be provided that the platform is rotatable about the vertical axis of rotation by the rotary device preferably in a yaw angle range of not more than 30°.

The rotary device can be part of the support, wherein the platform is rotatable relative to the support, preferably relative to the base thereof, via the rotary device.

Alternatively, the rotary device can be separate from the support, wherein the support as a whole—including the platform arranged thereon—is mounted so as to be rotatable by the rotary device. For example, such a rotary device can be in the form of a pedestal with a vertical axis of rotation.

The yaw angle is the angle by which the front face and the rear face of the platform rotate (also called "yawing" or lurching). The axis of rotation forms the Z-axis in a corresponding coordinate system.

In order for the simulator to be used effectively in the entertainment industry, it is preferably provided that there is arranged on the top face of the platform a plurality of viewing positions each having a supporting element for a spectator to lean against. For example, up to 30 viewing positions can be provided.

The supporting elements can be part of a seat, so that a spectator leans with his back against this supporting element. Preferably, however, the supporting elements are so designed that spectators stand in the viewing position. A spectator can thus lean with the front side of his body against the supporting element.

In order to ensure the safety of the spectators, it is preferably provided that there is provided in each viewing position a spectator restraint system, preferably in the form of a safety belt or safety bar, which is preferably connected to the respective supporting element.

According to a preferred exemplary embodiment there is provided a control or regulating unit for controlling or regulating movements of the platform.

It is particularly preferably provided that control signals are able to be outputted to the cable drive device, preferably to the drive assemblies thereof, via the control or regulating unit.

The motion simulator can be designed, for example, for a video game (e.g. for only one person). In this case, the movements depend on the steering and control movements of the person playing the game. Accordingly, it can preferably be provided here that the motion simulator is movable in dependence on control or steering movements initiated on a controller.

There is also provided, and protection is claimed, for an entertainment system having a screen, wherein a film is able to be shown on the screen, and a motion simulator according to the invention. Similarly, the moving pictures may also be displayed via VR devices (e.g., goggles). The entertainment system, furthermore, may be characterized by interactivity features where the movement behavior of a user (i.e., participating spectator) may interactively control the movement of the platform and/or the display.

It can particularly preferably be provided that the motion simulator is able to be moved in dependence on a motion data track—which corresponds to the film being shown on the screen.

There can be used as the screen a screen that is conventional in the entertainment field. 2D images (or 2D videos) or 3D images (or 3D videos) can be shown with this screen.

It is possible that the screen is part of a virtual reality application.

Generally, additional special effects can be produced with the entertainment system. Examples thereof which may be mentioned include water effects, wind effects, fog effects, light effects, shaking effects, etc.

According to a first variant, it is provided for the entertainment system that the screen is in the form of a (relatively large) screen which is separate from the motion simulator, wherein this screen is arranged in a region facing the front face and is oriented substantially orthogonally to the central axis. This variant thus corresponds to a cinema, in which all the spectators look at the same central screen. This screen can be in the form of, for example, a cinema screen onto which the images or a video is/are projected, or a fully surrounding display (i.e., 360° surround screen), or a full-screen dome in which images are displayed in a substantial hemisphere around and above the spectator.

It is also possible for the screen to be mounted to the moving platform so that the screen moves with the platform. In yet another embodiment, the display screens are individually associated with a single viewing position.

Such an entertainment system can be permanently installed in a room or a hall of an amusement park. Also, the system may be installed outside in an open environment, an amusement park, a water park, a museum, etc.

A possible application is also in a water park. In order to meet requirements here on account of the prevailing wetness, appropriately water-tight cable connections should be provided, appropriate metals should be used for the construction as a whole, the surfaces should have a water-resistant finish, the floor should be more slip-resistant, and higher-quality manufacture in general should be provided.

According to a second and alternative variant, it is provided for the entertainment system that each viewing position has an associated screen. Each spectator thus has a separate screen (preferably with a loudspeaker) on or in front of his supporting element. In other words, each viewing position including the supporting element and the screen forms a type of "mini cinema" (preferably with a sound system and special effects). In this variant, the screen thus always moves with the platform.

Especially this second variant is suitable for providing a mobile entertainment system and sparing a large projection area. Such a mobile entertainment system can easily be set up and dismantled and can also be erected and used for only a relatively short period of time, for example for festivals lasting several days or for other such events.

Other features which are considered as characteristic for the invention are set forth in the appended claims.

Although the invention is illustrated and described herein as embodied in motion simulator for an entertainment system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

and

Figure 17:
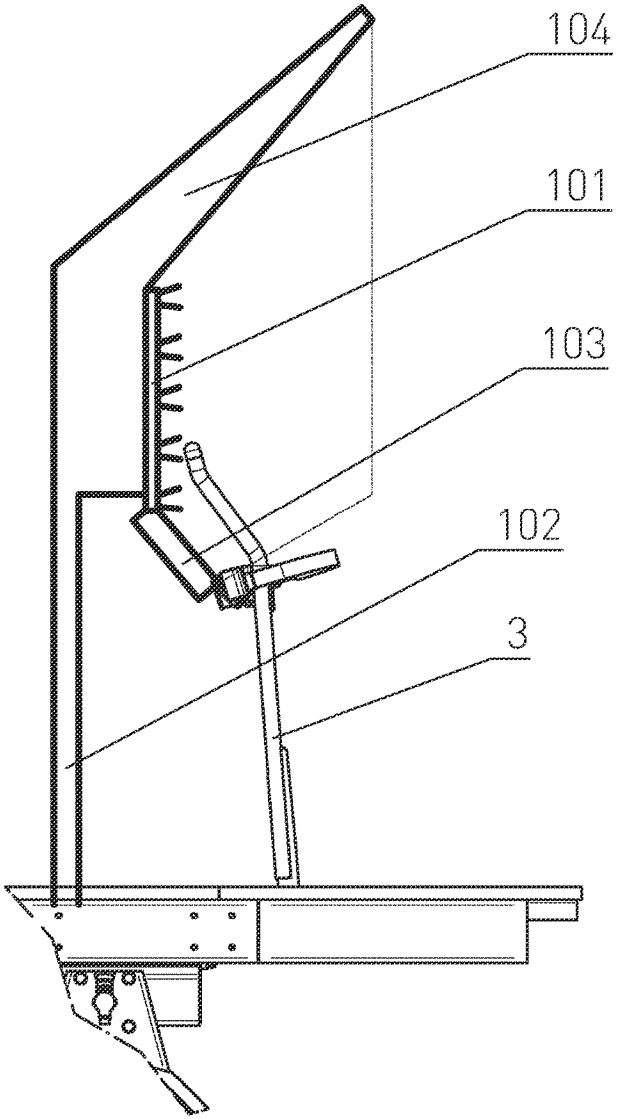

FIG. 17 shows a detail of a side view with a screen associated with the viewing position.

DETAILED DESCRIPTION OF THE INVENTION

Figure 1:
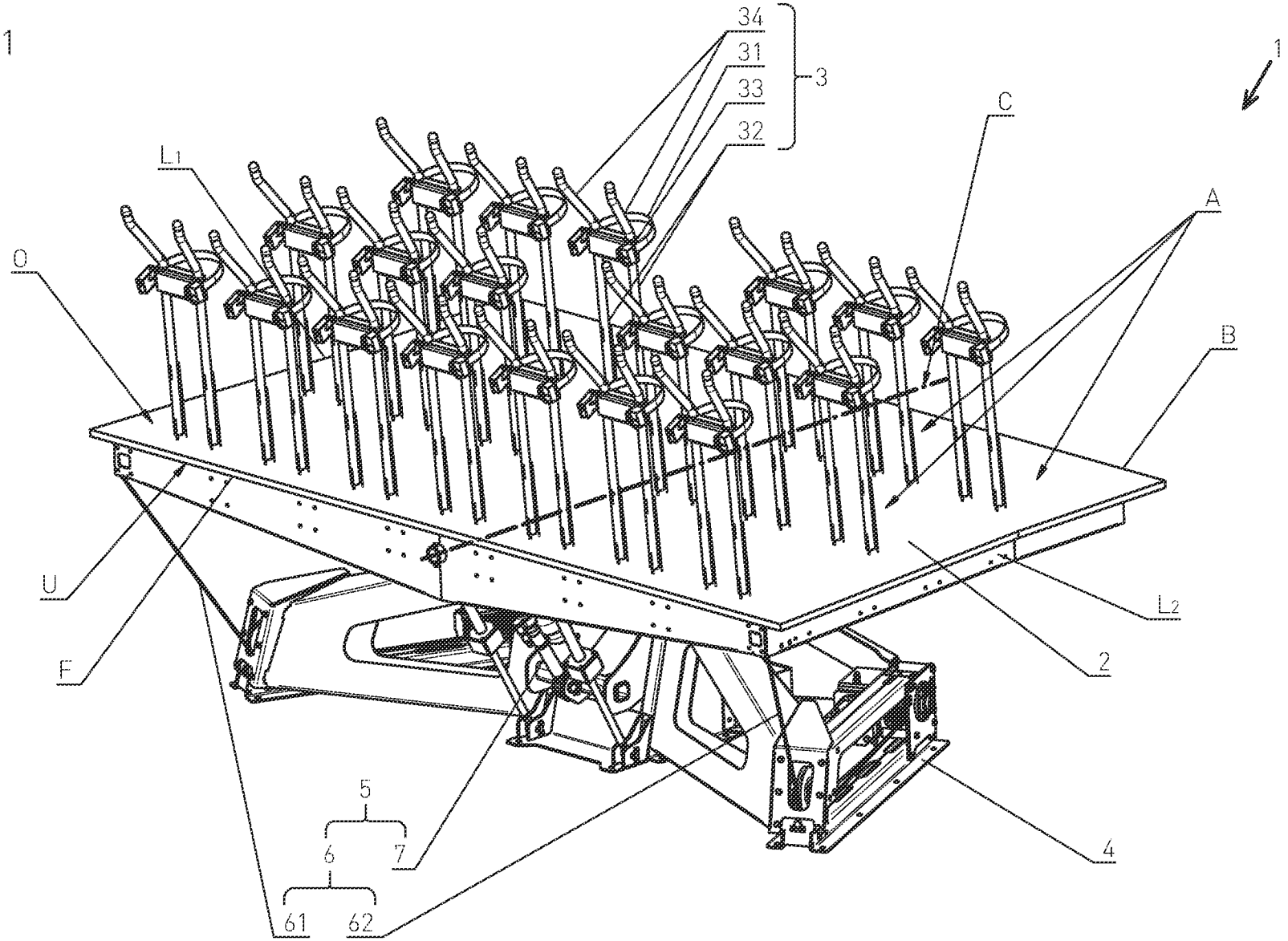
FIG. 1 is a perspective view of a motion simulator according to the invention.

Referring now to the figures of the drawing in detail and first, in particular, to FIG. 1 thereof, there is shown a motion simulator 1. This motion simulator 1 comprises as its fundamental components a platform 2, a support 4 arranged beneath the platform 2, and a drive device 5 for moving the platform 2 relative to the support. The drive device 5 in turn has an energy storage device 7 and a cable drive device 6.

In the exemplary embodiment shown in FIG. 1, the cable drive device 6 has a first cable drive unit 61 and a separate second cable drive unit 62.

On the movable platform 2 there is arranged a plurality of viewing positions A for spectators, wherein there is a supporting element 3 in each viewing position A. Specifically, in the exemplary embodiment shown, eighteen supporting elements 3 are arranged on the platform 2.

Each supporting element 3 has uprights 32, preferably metallic uprights, a rest 33, two handle bars 34 and a spectator restraint system 31 (preferably in the form of a safety belt).

The platform 2 has a (preferably smooth) top face O and an opposite bottom face U.

The platform 2 can have any desired contour. Preferably, the platform 2, in a plan view, is substantially quadrangular. In the exemplary embodiment shown in FIG. 1, the platform is trapezoidal at least in some regions.

The platform 2 has a front face F, a rear face B, a first lateral region L1, and a second lateral region L2. The central axis C runs through the middle of the platform from the rear face B to the front face F.

In the exemplary embodiment shown, the central axis C divides the platform 2 (or the base plate 21 thereof) into two substantially mirror-symmetrical regions of equal size.

Figure 2:
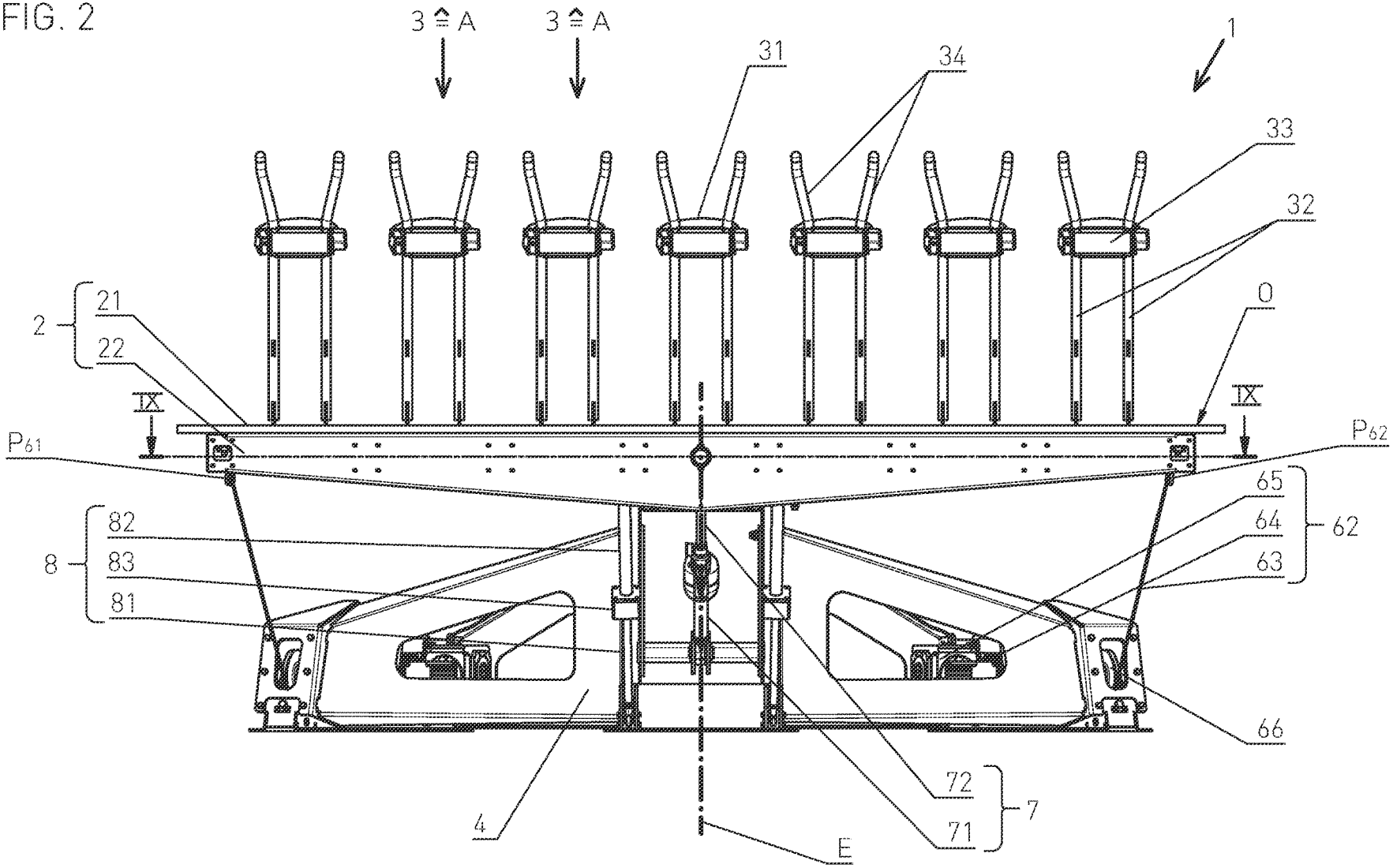
FIG. 2 is a front view of the motion simulator.

FIG. 2 is a front view of the motion simulator 1. On the top face O of the platform 2 there is again arranged a plurality of viewing positions A with supporting elements 3.

It can also be seen in FIG. 2 that the platform 2 has a base plate 21 and frame elements 22, preferably profiled frame elements, whereby a stable construction is obtained.

By means of the second cable drive unit 62 it can be seen that this—like the first cable drive unit 61—has a cable 63 fastened to the platform 2, a cable drive 64 movably mounted on the support 4, and a drive assembly 65. In addition, a deflecting roller 66 for the cable 63 can—as shown—also be rotatably mounted on the support 4.

The cable 63 of the first cable drive unit 61 is connected to the platform 2 (preferably to the frame element 22 thereof) via the first attachment point P61. The cable 63 of the second cable drive unit 62 is also connected to the platform 2 (preferably to the frame element 22 thereof) via the second attachment point P62.

Of course, these attachment points P61 and P62 (and this also applies to the energy storage device attachment point P7) are not to be considered as a one-dimensional "point" in the geometrical sense. Rather, these attachment points are to be regarded as attachment regions or fastening locations.

It can be seen particularly clearly in FIG. 2 that the first attachment point P61 and the second attachment point P62 to the platform 2 are arranged on mutually opposite sides of the central axis C, wherein the first attachment point P61 and the second attachment point P62 are at the same distance from the central axis C.

The vertical plane E which encloses the central axis C is depicted in FIG. 2.

FIG. 2 also shows the centrally arranged energy storage device 7. Specifically, it is provided that the energy storage device is in the form of a hydropneumatic spring element and has a piston 72 attached to the platform 2 and a cylinder 71 attached to the support 4. The arrangement of the piston 72 and the cylinder 71 can of course also be reversed.

It can further be seen in FIG. 2 that two braking devices 8 for braking the movement of the cable drive device 6 and/or of the energy storage device 7 are provided, wherein the two braking devices 8 are fastened on the one hand to the support 4 and on the other hand to the platform 2. The two braking devices 8 are arranged on either side of the plane E. Specifically, the braking devices 8—in the zero position shown—are arranged mirror-symmetrically with respect to one another.

The braking devices 8 each have a piston rod 81 and a cylinder 82, wherein the piston rod 81 is movably guided in the cylinder 82. It can preferably be provided that the piston rod 81 is able to be braked in the cylinder 82 by frictional engagement or by positive engagement by a clamping element 83.

Figure 3:
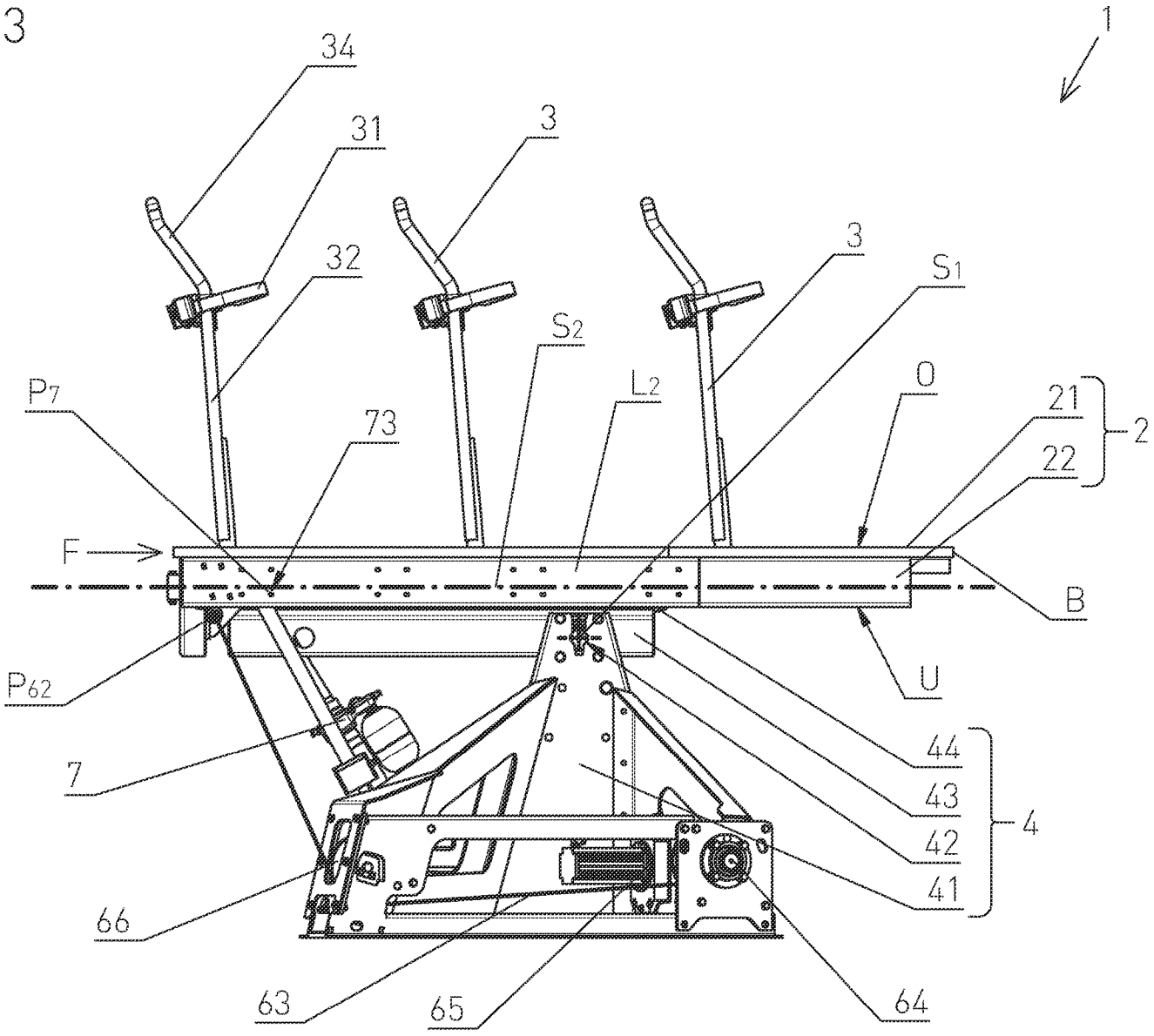
FIG. 3 is a side view of the motion simulator.

In FIG. 3, the motion simulator 1 is shown in a side view. Here too, the platform 3 is in the same neutral zero position as in FIG. 2.

It can clearly be seen in FIG. 3 that the support 4 has a base 41, a first pivot bearing 42, and a pivot element 43 which is connected to the platform 2 and is mounted on the first pivot bearing 42 so as to be pivotable about the first pivot axis S1.

In the exemplary embodiment shown, the pivot bearing 42 has a pivot pin formed on the pivot element 43 and a bearing for the pivot pin formed in the base 41.

FIG. 3 also shows the second cable drive unit 62 including the drive assembly 65, the cable drive 64 (in the form of a cable reel) and the cable 63, and also the deflecting roller 66. The second attachment point P62 is also visible. It can additionally be seen in FIG. 3 that the energy storage device 7 is fastened on the one hand to the support 4 and on the other hand via an energy storage device attachment point P7 to the platform 2.

Therefore, it can be seen particularly clearly in FIG. 3 that the energy storage device attachment point P7 and the at least one attachment point P61, P62 of the cable drive device 6 to the platform 2 are arranged between the first pivot axis S1 and the front face F.

It can further be seen rudimentarily in FIG. 3 that the support 4 has a second pivot bearing 44, in this case formed in or on the pivot element 43, for the platform 2, wherein the second pivot bearing 44 has a second pivot axis S2 preferably oriented orthogonally to the first pivot axis S1.

Figure 4:
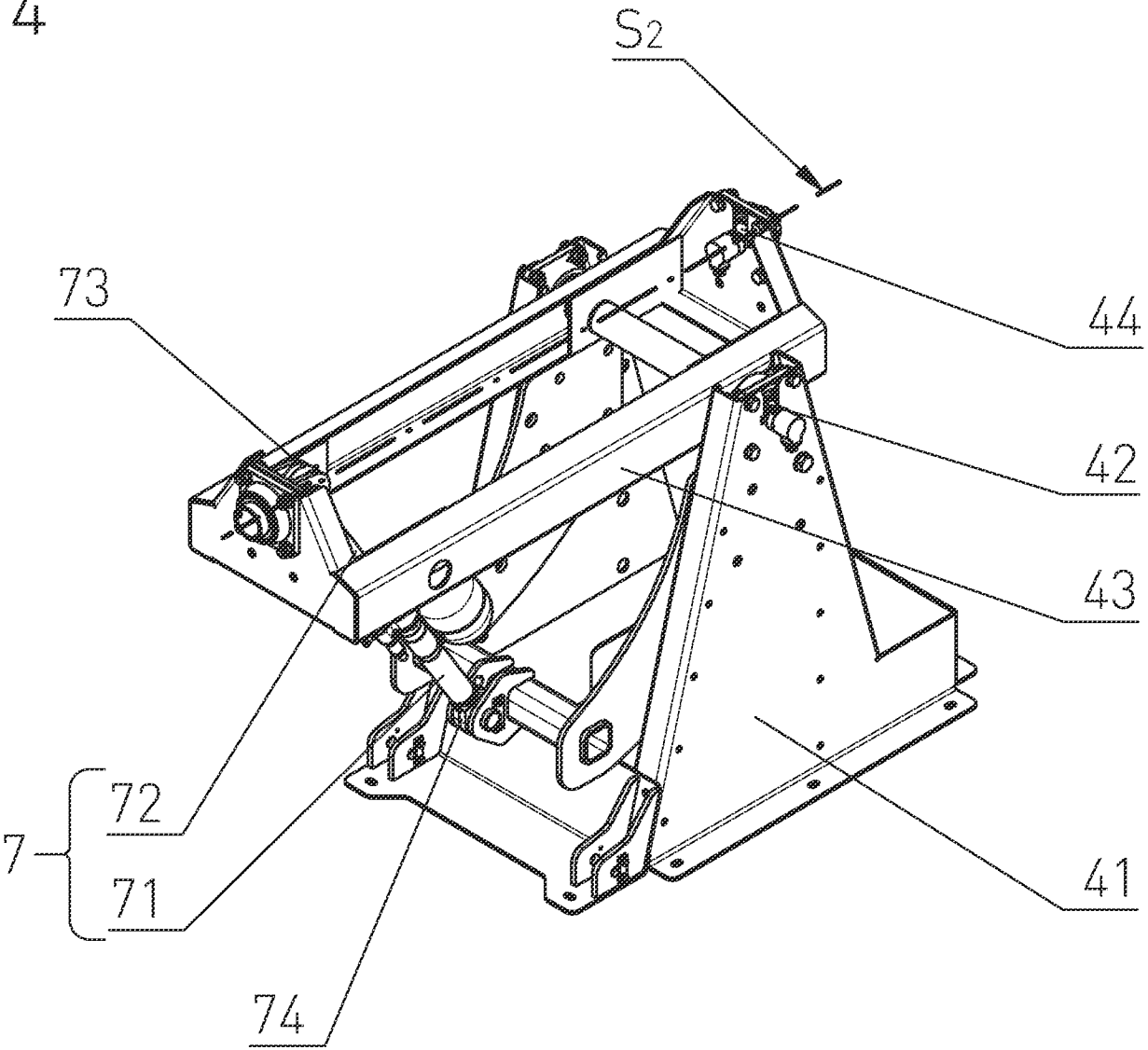
FIG. 4 is a perspective view of the support with the second pivot axis.

FIG. 4 shows only the carrier 4 without the platform 2 but with the energy storage device 7.

The energy storage device 7 is connected indirectly to the platform 2 via the pivot element 43 of the support 4. The energy storage device 7 has a cylinder 71, which is attached to the platform 2 via a rotary joint 73, and a piston 72, which is attached to the support 4 via a rotary joint 74.

The pivot element 43 is in the form of a frame. The bearing points of the pivot bearing 44 for the pivot axis S2 are formed at an end facing the rear face B and at an end facing the front face F. The platform 2 is mounted on these bearing points via corresponding bearing points (which are formed on the frame element 22).

Figure 5:
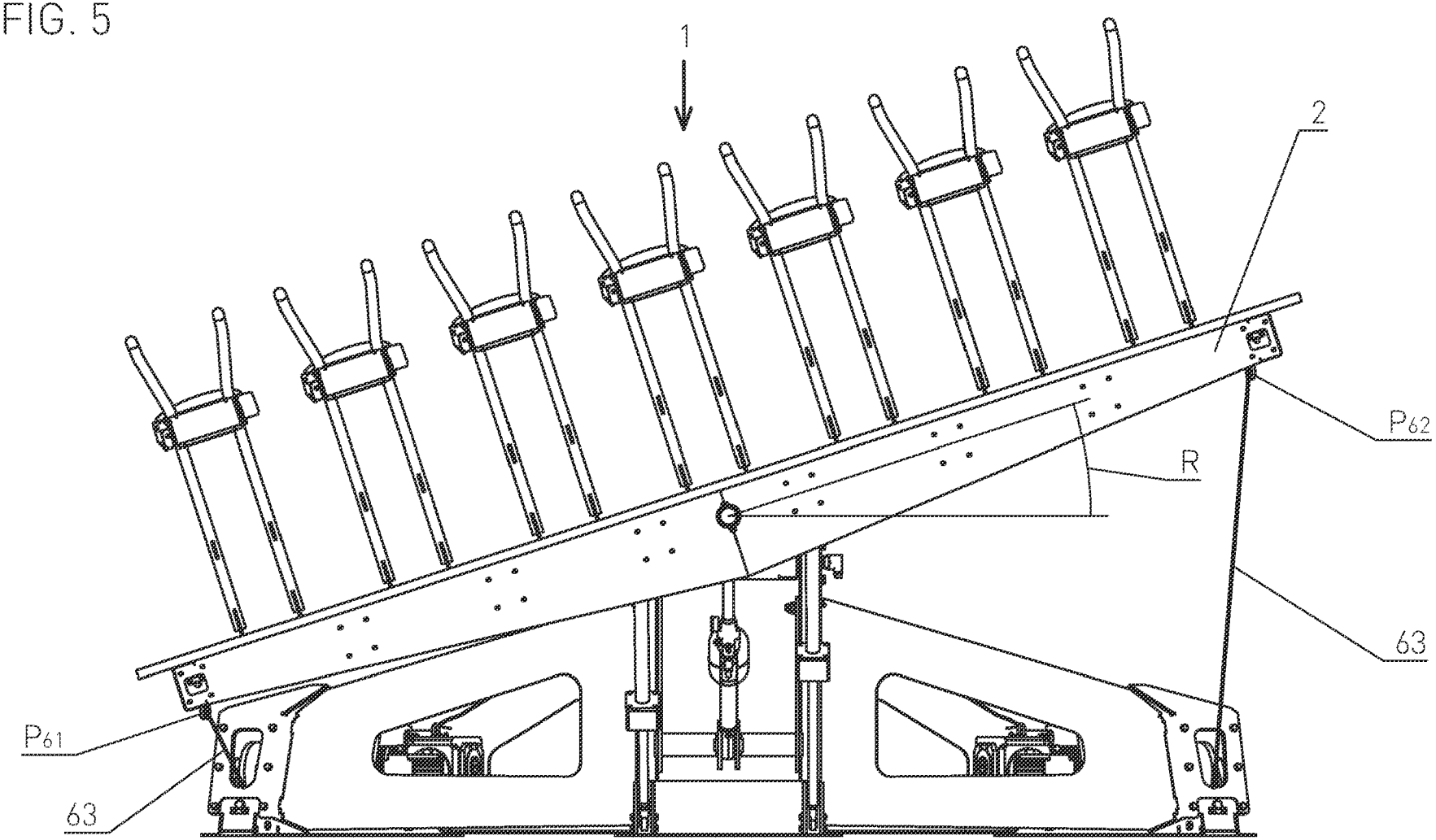
FIG. 5 is a front view with the platform tilted about the second pivot axis.

FIG. 5 shows the motion simulator 1 as a whole again, wherein the platform 2 is in a tilted or pivoted position compared to the zero position of FIG. 2.

By pulling the first cable drive unit 61 of the cable drive device 6, the platform is able to be tilted about the second pivot axis S2. Simultaneously with this pulling, the cable 63 of the second cable drive device 62 is pulled out. This can take place by an actively controlled movement of the cable drive 65 of the second cable drive unit 62. Alternatively, the cable drive 65 of the second cable drive unit 62 can be switched to idle, so that the cable 63 thereof is pulled out by the upward movement of the platform 2.

The movement about the second pivot axis S2 corresponds to a movement by a roll angle. Based on the dimensions and the limited possibilities of movement between the platform 2 and the support 4, the roll angle range R of about 20° shown in FIG. 5 is obtained.

FIG. 5 additionally shows how the braking devices 8 lengthen or shorten according to the tilting movement or rolling movement of the platform 2.

Figure 6:
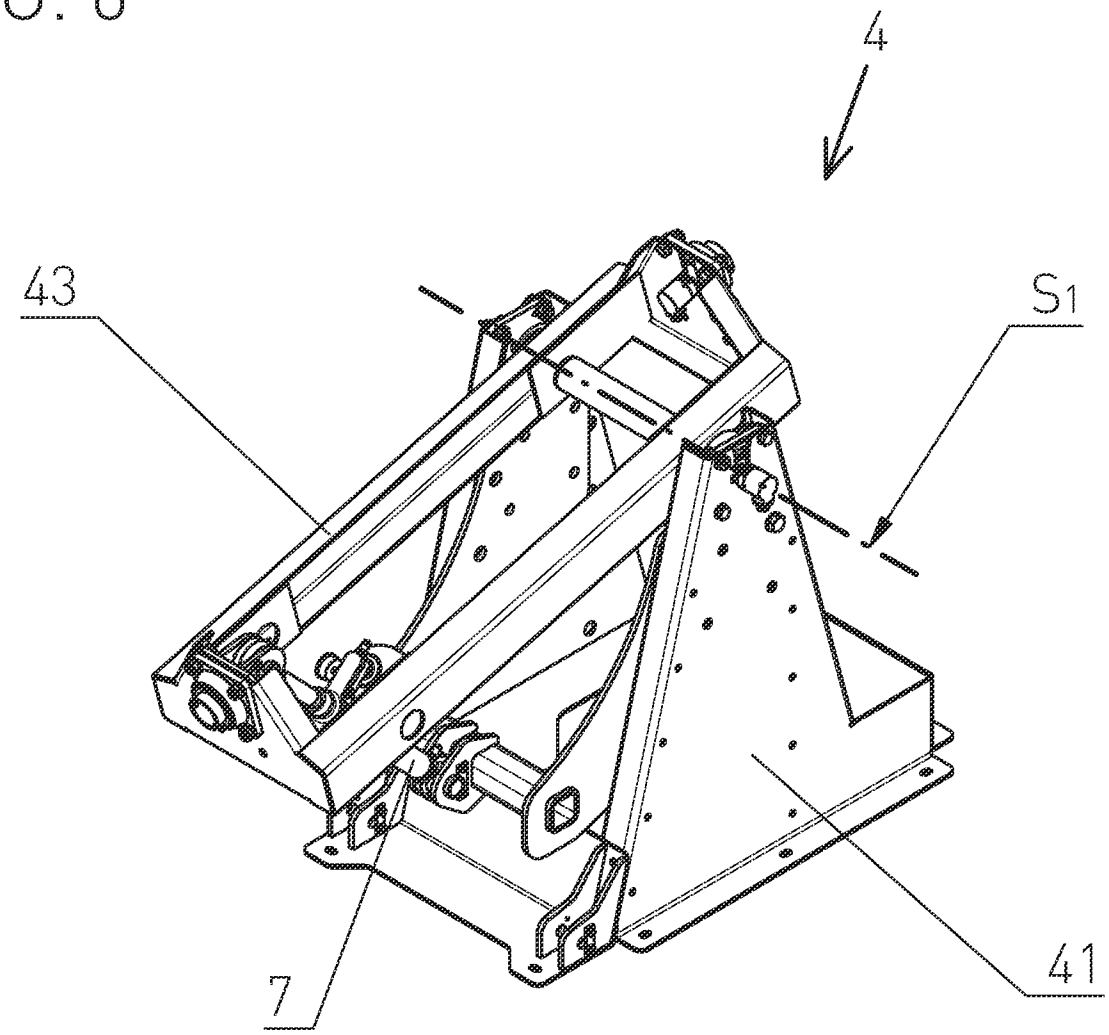
FIG. 6 is a perspective view of the support with the first pivot axis.

In FIG. 6—as in FIG. 4—only the support 4 together with the energy storage device 7 is shown. The pivot element 43 is inclined about the first pivot axis S1.

Figure 7:
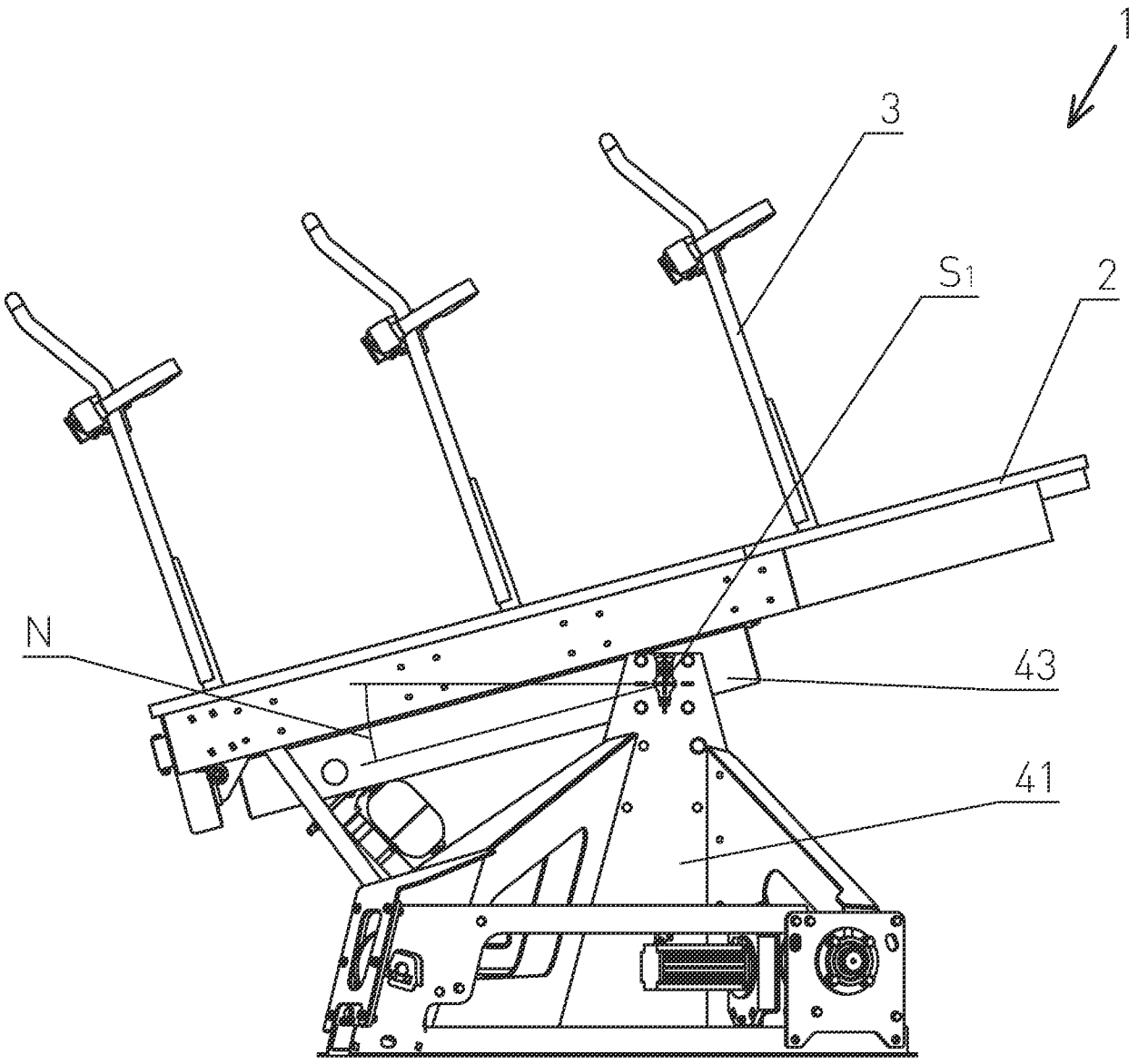
FIG. 7 is a side view with the platform tilted about the first pivot axis.

FIG. 7 shows a position in which the platform 2 is tilted forward compared to FIG. 3. By simultaneously pulling the first cable drive unit 61 and the second cable drive unit 62 at the respective attachment points P61 and P62, the platform 2 is tilted about the first pivot axis S1.

The movement about the first pivot axis S1 corresponds to a movement by a pitch angle. Based on the dimensions and the limited possibilities of movement between the platform 2 and the support 4, the pitch angle range N of about 20° shown in FIG. 7 is obtained.

If the two cable drive units 61 and 62 are actuated at the same speed (and force), a tilting movement solely about the first pivot axis S1 is carried out. The second pivot axis S2 remains unchanged.

If the two cable drive units 61 and 62 are actuated at different speeds, a tilting movement about the second axis S2 also takes place in addition to the tilting movement about the first pivot axis S1. Depending on which of the two cable drive units 61 and 62 is activated or operated with the higher speed, a rolling movement takes place in the direction of that cable drive unit 61 or 62.

The energy storage device 7 is so configured that it pushes against the bottom face U of the platform 2. The energy storage device 7 thus always tries to push the platform 2 upward. However, because the cable drive device 6 is stronger than the energy storage device 7, the energy storage device 7 is compressed or additionally loaded—as can be seen in FIG. 7. As soon as at least one of the two cable drive units 61 and/or 62 is activated such that the respective cable 63 can be pulled out or unwound again, the energy storage device 7 is able to deploy its force and pushes the platform 2—at least as far as the two cable drive units 61 and 62 allow—upward about the first pivot axis S1.

Figure 8:
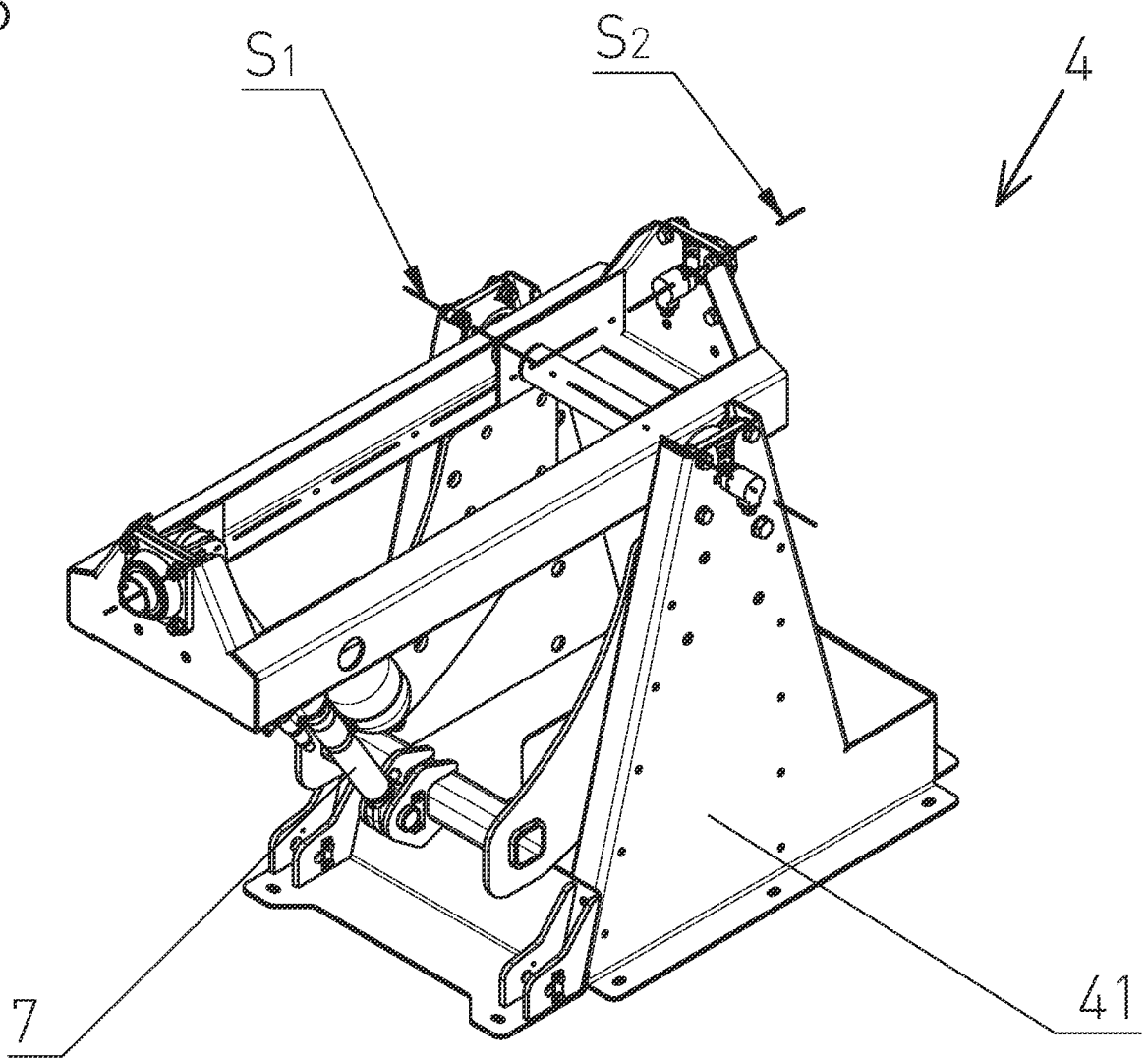
FIG. 8 is a perspective view of the support with the two pivot axes.

FIG. 8 then shows the support 4 (again without the platform 2) when the energy storage device 7 has relaxed again.

The two pivot axes S1 and S2 are depicted in FIG. 8, wherein the first pivot axis S1 is oriented orthogonally to the second pivot axis S2.

Figure 9:
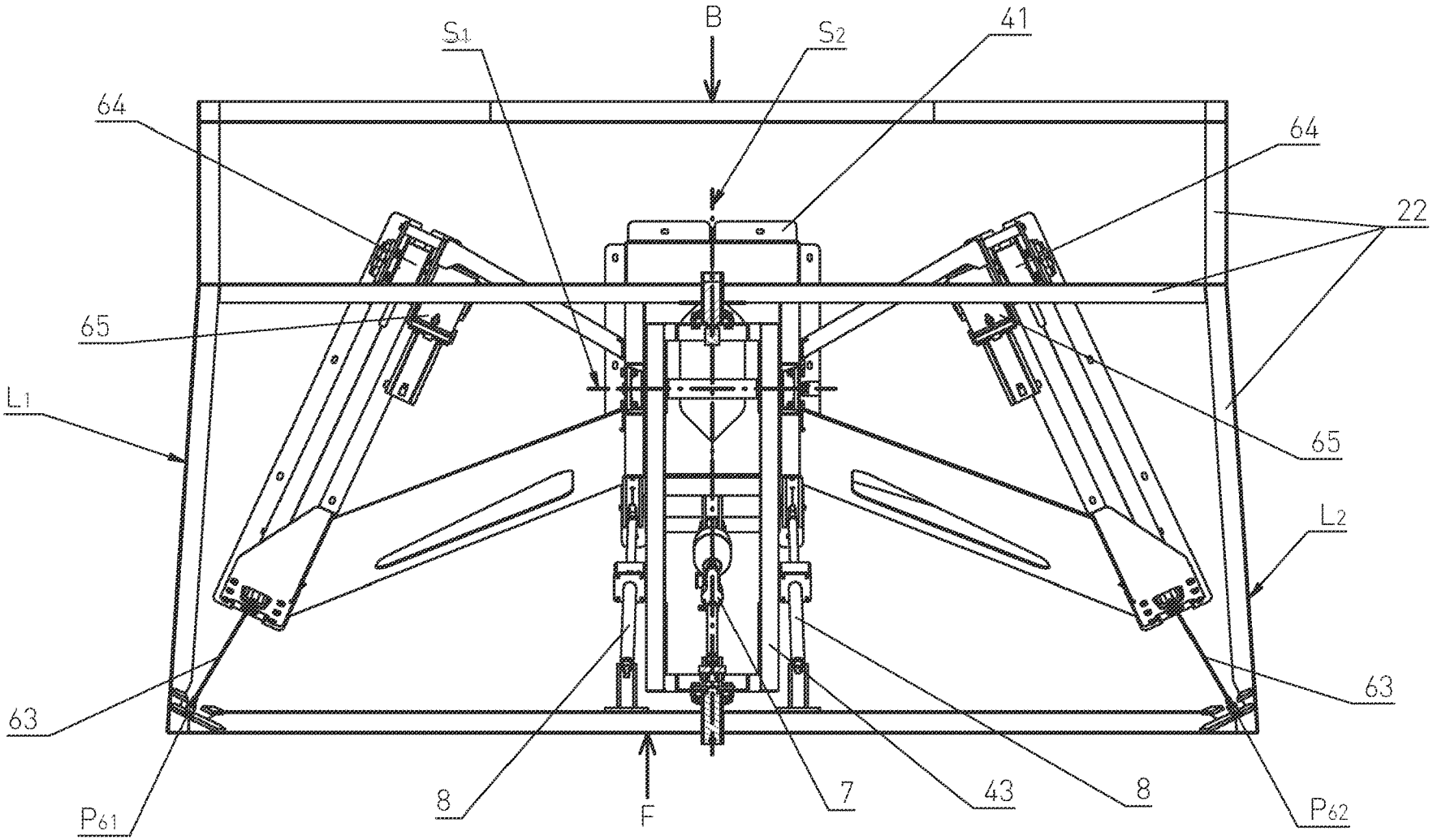
FIG. 9 shows section IX-IX according to FIG. 2.

FIG. 9 shows the section taken along the line IX-IX in FIG. 2, viewed in the direction of the arrows. The frame elements 22 of the platform 2 can be seen particularly clearly in this illustration. The individual elements of the support 4 (e.g. base 41 and pivot element 43) are also shown. The drive assemblies 65 are fixed to the support 4. The cables 63 of the cable drive units 61 and 62 can be wound and unwound via the cable drives 64 in the form of cable reels.

FIGS. 10 to 15 show different tilted positions of the platform 2 of the motion simulator 1, wherein in each case a side view is shown on the left and a front view is shown on the right. The indicated angle of the X-axis corresponds to the pitch angle range N about the first pivot axis S1. The indicated angle of the Y-axis corresponds to the roll angle range R about the second pivot axis S2. The two tilting movements can of course be superposed.

Figure 10:
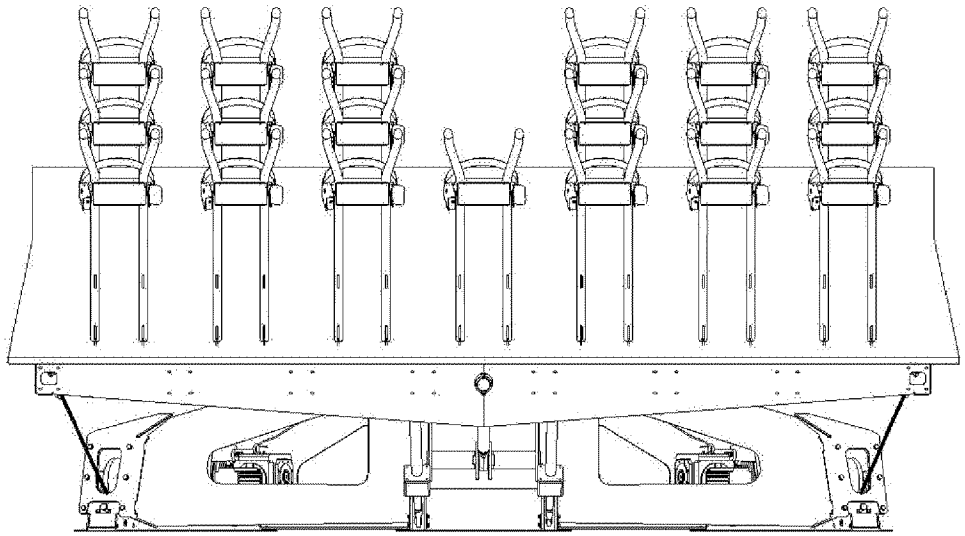
FIG. 10-15 show different tilted positions of the platform.
Figure 10:
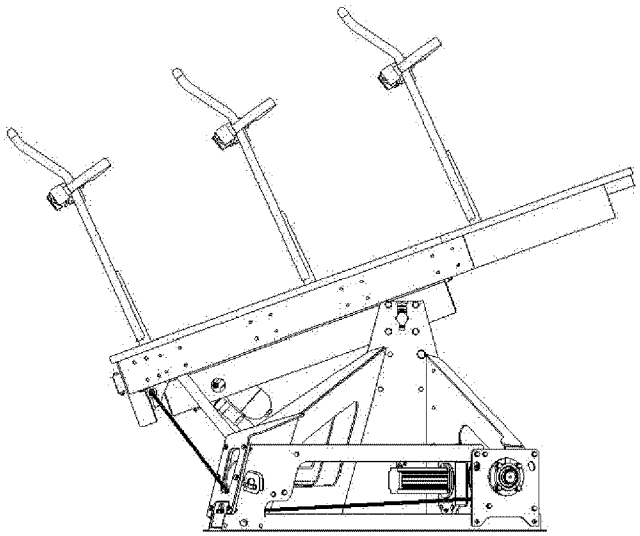

In FIG. 10, the platform 2 is tilted forward by 20°. No rolling movement has taken place.

Figure 11:
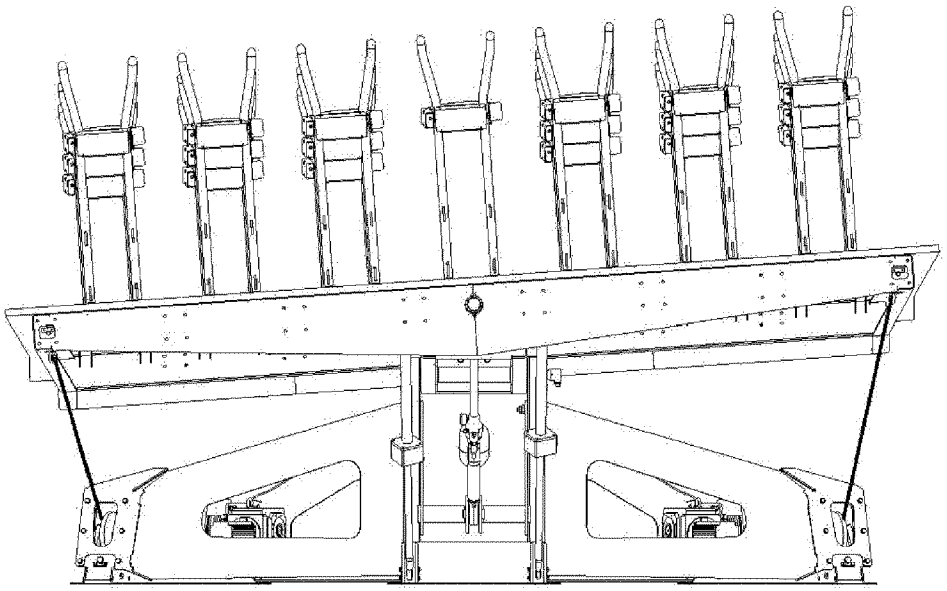
Figure 11:
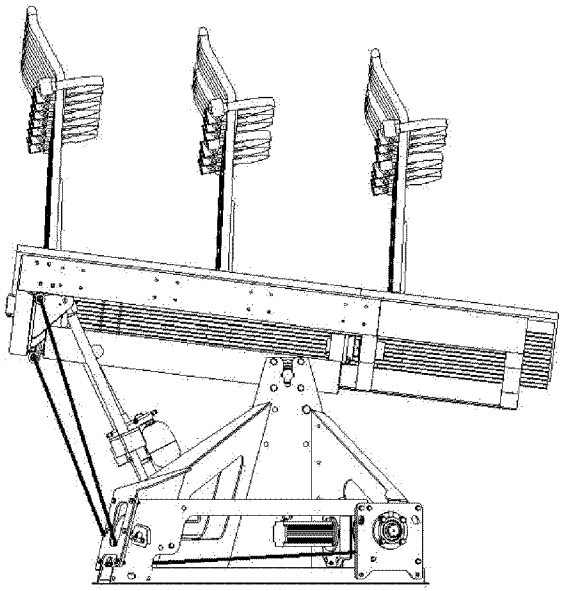

In FIG. 11, the platform 2 pitches upward by 7°, wherein this is initiated by the energy storage device 7 when the cable drive device 6 reduces the cable tension or unwinds the cable 63. In addition—starting from a zero position—the cable 63 of the second cable drive unit 62 has been unwound further than the cable of the first cable drive unit 61, so that a slight rolling movement of 4° to the left has also taken place.

Figure 12:
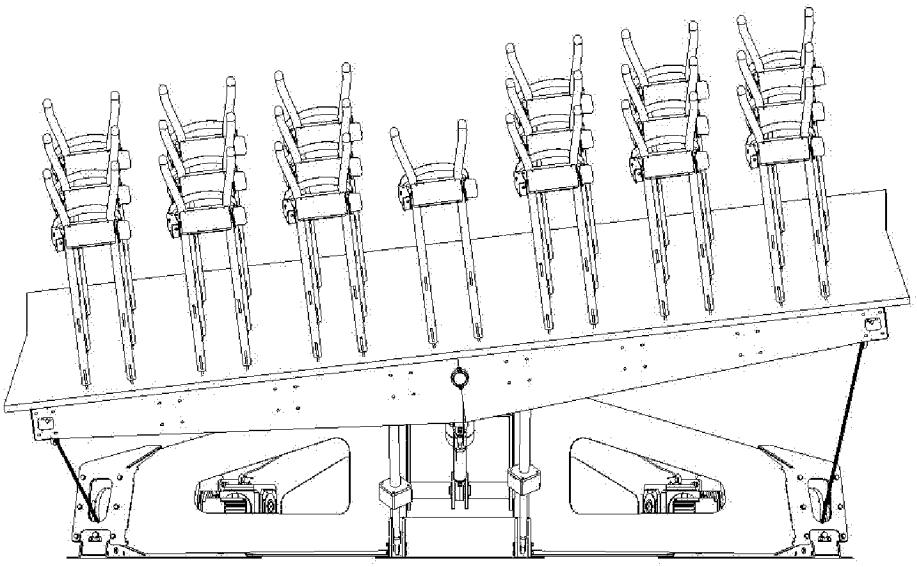
Figure 12:
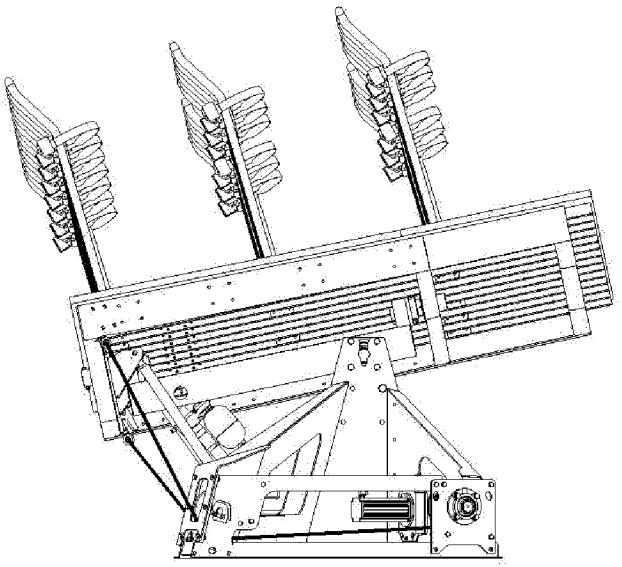

In FIG. 12, the platform 2 is tilted forward again by 12°. The rolling movement to the left has increased to 7°.

Figure 13:
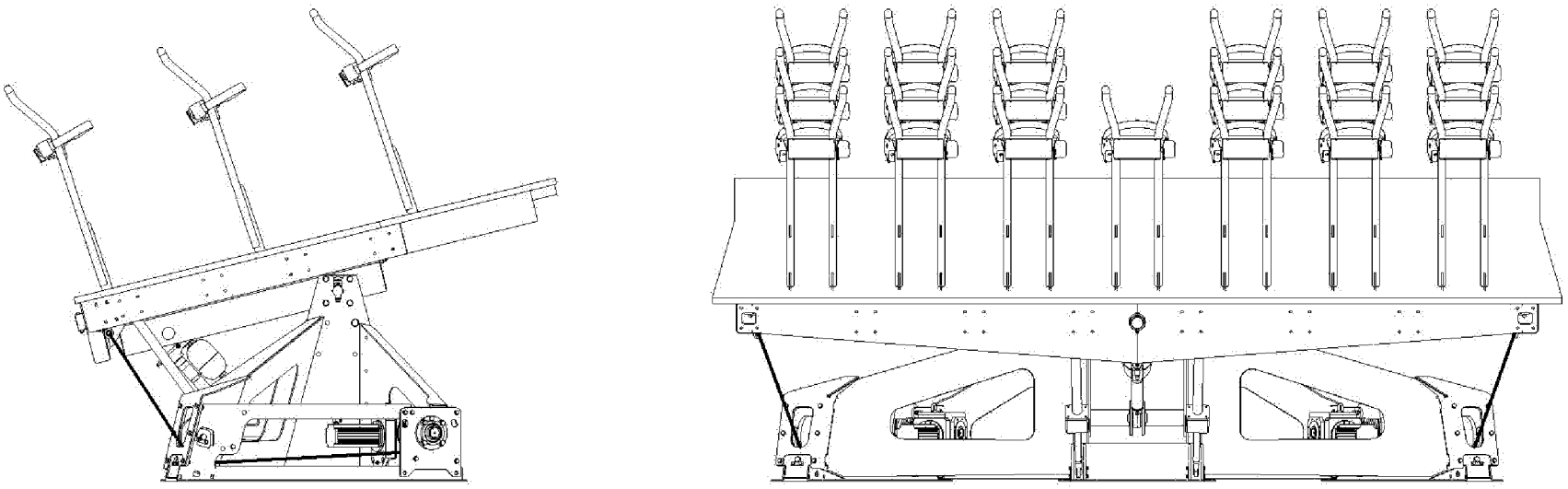

In FIG. 13, on the other hand, the zero position relative to the second pivot axis S2 is given. The platform 2, starting from the zero position, is tilted forward by 14° about the first pivot axis S1.

Figure 14:
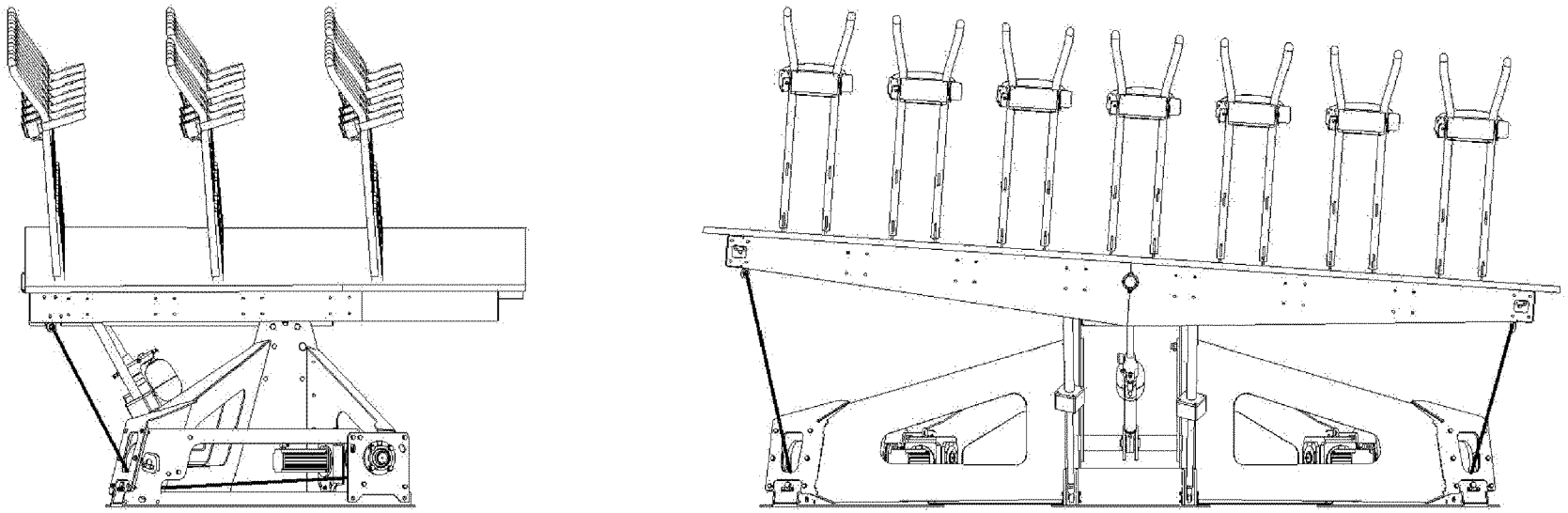

FIG. 14 shows the zero position of the pitching movement, while there is a slight rolling movement by 4° to the right.

Figure 15:
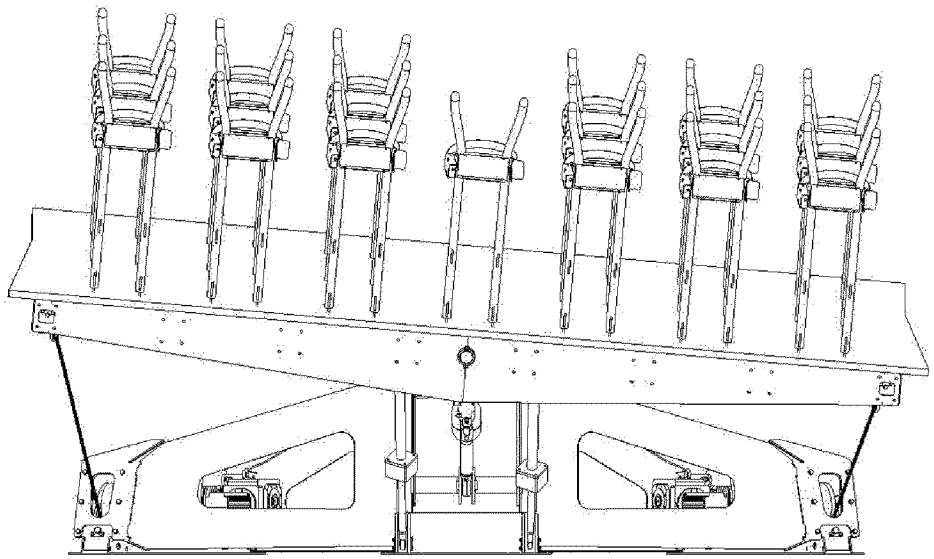
Figure 15:
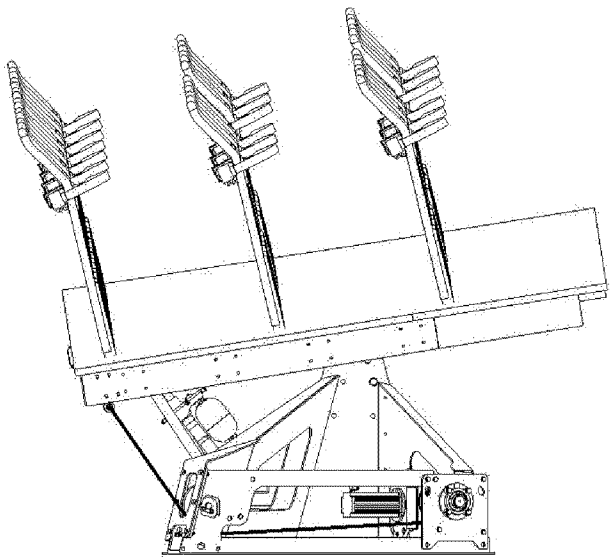

Finally, FIG. 15 shows a pitching movement downward by 9° and a rolling movement to the right by 5°.

Figure 16:
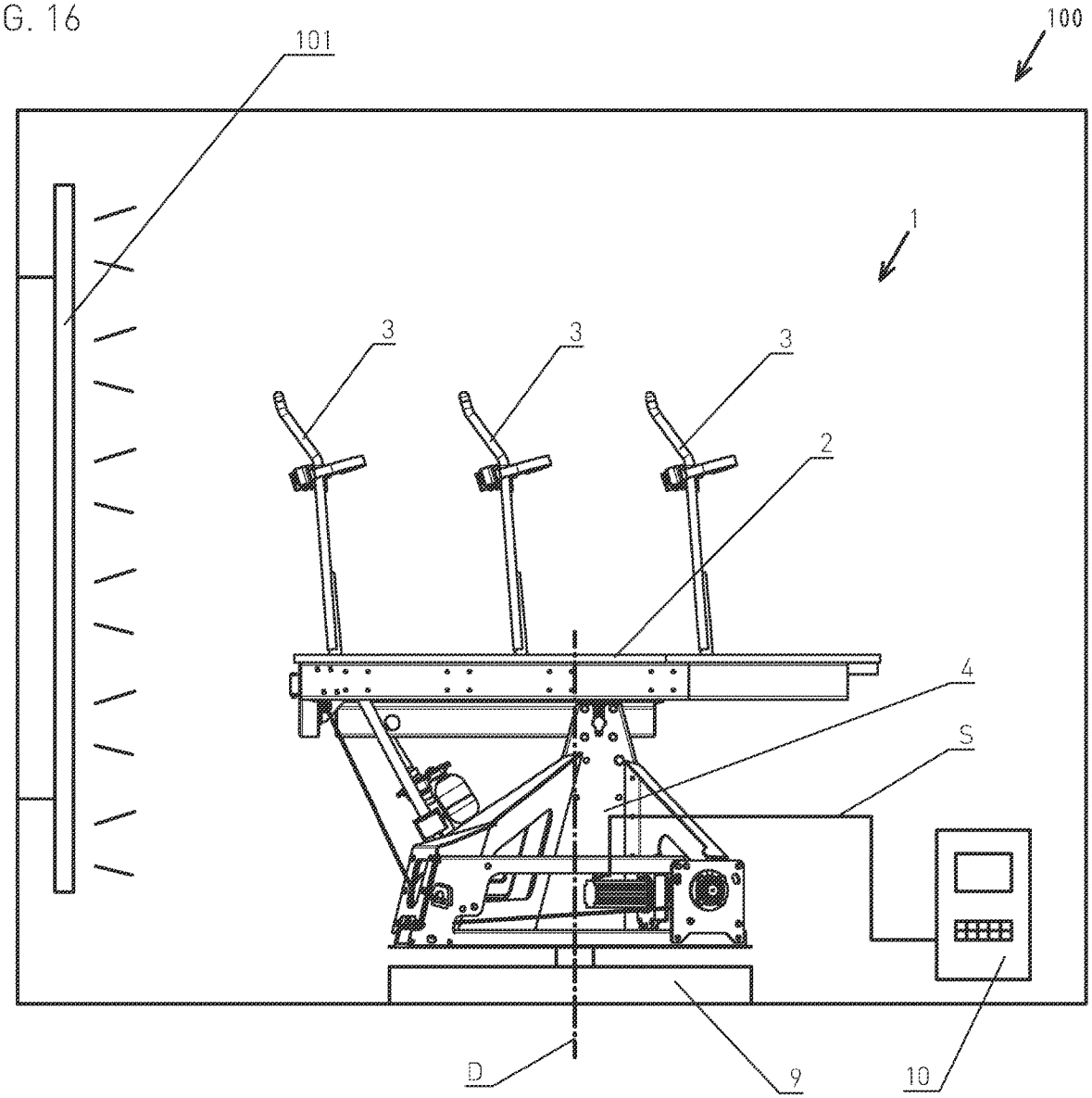
FIG. 16 shows, schematically, the entertainment system with a screen.

FIG. 16 shows, schematically, an entertainment system 100 as a whole. This entertainment system has a screen 101 and the motion simulator 1.

FIG. 16 shows an embodiment variant in which the platform 2 can additionally be rotated about the axis of rotation D via a rotary device 9. This corresponds to a movement by the yaw angle.

FIG. 16 further shows, schematically, the control or regulating unit 10 for controlling or regulating movements of the platform 2, wherein control signals S are able to be outputted via the control or regulating unit 10 to the cable drive device 6, preferably to the drive assemblies 65 thereof.

In contrast to the variant shown in FIG. 16, the screen 101 can also be connected directly to the platform 2.

Accordingly, FIG. 17 shows a viewing position A, wherein a screen 101 is associated with this viewing position. Specifically, this screen 101 is located in front of the supporting element 3 in the viewing direction.

In FIG. 17, the screen 101 is part of an independent housing 105. This housing 105 can be mounted on the platform 2 via a mounting element 104. Devices for generating special effects (not shown) can be integrated into this housing 105. Furthermore, a control device 103 can be arranged in the vicinity of, preferably beneath, the screen 101. Such a screen 101 with a housing 105 is preferably associated with each viewing position A. The variant shown in FIG. 17 is particularly suitable for mobile applications, which can be set up and also dismantled again relatively quickly.

The following is a summary list of reference numerals and the corresponding structure used in the above description of the invention:

1 motion simulator
2 movable platform
21 base plate
22 frame elements
3 supporting element
31 spectator restraint system
32 upright
4 support
41 base
42 first pivot bearing
43 pivot element
44 second pivot bearing
5 drive device
6 cable drive device
61 first cable drive unit
62 second cable drive unit
63 cable
64 cable drive
65 drive assembly
66 deflecting roller
7 energy storage device
71 cylinder
72 piston
73 rotary joint
74 rotary joint
8 braking device
81 piston rod
82 cylinder
83 clamping element
9 rotary device
10 control or regulating unit
100 entertainment system
101 screen
103 control device
104 mounting element
105 housing
O top face
U bottom face
F front face
B rear face
C central axis
A viewing position
P61 attachment point of the first cable drive unit of the cable drive device 6
P62 attachment point of the second cable drive unit of the cable drive device 6
P7 energy storage device attachment point
S1 first pivot axis
S2 second pivot axis
N pitch angle range
R roll angle range
L1 first lateral region
L2 second lateral region
D axis of rotation
S control signals
M motion data track
E vertical plane

The invention claimed is:

1. A motion simulator for an entertainment system, the motion simulator comprising:

a movable platform having a top face, a bottom face, a front face, a rear face, and a central axis extending from said rear face to said front face, wherein said top face having at least one viewing position with a supporting element for spectators to lean against;

a support for said platform, said bottom face of said platform being mounted on said support so as to have limited movability; and a drive device for moving said movable platform relative to said support, said drive device including:

a cable drive device for pulling said platform, said cable drive device being fastened to said support and to at least one attachment point at said platform; and an energy storage device fastened to said support and, via an energy storage device attachment point, to said platform;

said platform being pivotable by said drive device about a first pivot axis oriented substantially orthogonally to said central axis;

said energy storage device attachment point and said at least one attachment point attaching said cable drive device to said platform being arranged between said first pivot axis and said front face; and said energy storage device being disposed to push against said bottom face of said platform.

2. The motion simulator according to claim 1, wherein said support has a base, a first pivot bearing, and a pivot element connected to said platform and mounted on said first pivot bearing so as to be pivotable about the first pivot axis.

3. The motion simulator according to claim 1, wherein said energy storage device attachment point to said platform lies within a vertical plane enclosing the central axis.

4. The motion simulator according to claim 1, wherein said platform, upon a relaxation of said energy storage device, is mounted for tilting about said first pivot axis within a given pitch angle range of not more than 30°.

5. The motion simulator according to claim 1, wherein said support has a second pivot bearing for said platform, said second pivot bearing having a second pivot axis oriented parallel to said central axis and orthogonal to said first pivot axis.

6. The motion simulator according to claim 5, wherein said second pivot axis lies in a vertical plane enclosing said central axis.

7. The motion simulator according to claim 5, wherein said platform, by pulling the cable drive device, is tilted about said second pivot axis within a roll angle range of not more than 25°.

8. The motion simulator according to claim 1, wherein said cable drive device comprises a first cable drive unit and a second cable drive unit separate from said first cable drive unit, wherein said first cable drive unit is fastened between said support and, via a first attachment point, to said platform, and said second cable drive unit is fastened between said support and, via a second attachment point to said platform.

9. The motion simulator according to claim 8, wherein said first attachment point and said second attachment point to said platform are arranged between said first pivot axis and said front face.

10. The motion simulator according to claim 8, wherein said first attachment point of said first cable drive unit to said platform is arranged between said second pivot axis and a first lateral region of said platform, and wherein said second attachment point of said second cable drive unit to said platform is arranged between said second pivot axis and a second lateral region of said platform, said second lateral region being opposite said first lateral region.

11. The motion simulator according to claim 8, wherein said first attachment point and said second attachment point to said platform are arranged on mutually opposite sides of said central axis.

12. The motion simulator according to claim 8, wherein each of said first and second cable drive units has a cable fastened to said platform, a cable drive for moving said cable, and wherein said cable drive is mounted on said support, and a drive assembly for driving said cable drive.

13. The motion simulator according to claim 12, wherein said cable drive is a rotatably mounted cable reel for winding and unwinding the cable, said drive assembly is an electromotive drive, and said cables are deflectable about deflecting rollers rotatably mounted on said support.

14. The motion simulator according to claim 1, wherein said platform is configured for tilting about said first pivot axis by simultaneous actuation of two cable drive units of said cable drive device.

15. The motion simulator according to claim 1, wherein said energy storage device is a gas spring with a cylinder and a piston attached, via respective rotary joints to said platform and said support.

16. The motion simulator according to claim 1, further comprising at least one braking device for braking a movement of said cable drive device and/or of said energy storage device, said braking device being operatively fastened between said support and said platform.

17. The motion simulator according to claim 16, wherein said braking device includes a piston rod and a cylinder, and a clamping element configured for braking said piston rod in said cylinder by frictional engagement or by positive engagement.

18. The motion simulator according to claim 1, further comprising a rotary device for rotating said platform about a substantially vertical axis of rotation.

19. The motion simulator according to claim 1, wherein there is arranged on said top face of said platform a plurality of viewing positions each having a supporting element for a spectator to lean against and, in each viewing position a spectator restraint system.

20. The motion simulator according to claim 1, further comprising a closed-loop or open-loop control or regulating unit for controlling or regulating movements of said platform, said control unit being configured to output control signals to said cable drive device.

21. An entertainment system, comprising: a screen for displaying a film, and a motion simulator according to claim 1 configured to be moved in dependence on a motion data track corresponding to the film being shown on said screen.

* * * * *